US011631566B2

(12) United States Patent
Hetzmannseder

(10) Patent No.: US 11,631,566 B2
(45) Date of Patent: Apr. 18, 2023

(54) MODULAR HIGH VOLTAGE FUSE

(71) Applicant: Littelfuse, Inc., Chicago, IL (US)

(72) Inventor: Engelbert Hetzmannseder, Chicago, IL (US)

(73) Assignee: Littelfuse, Inc., Chicago, IL (US)

( * ) Notice: Subject to any disclaimer, the term of this patent is extended or adjusted under 35 U.S.C. 154(b) by 0 days.

(21) Appl. No.: 17/510,742

(22) Filed: Oct. 26, 2021

(65) Prior Publication Data

US 2022/0157548 A1 May 19, 2022

Related U.S. Application Data

(60) Provisional application No. 63/113,342, filed on Nov. 13, 2020.

(51) Int. Cl.
*H01H 85/38* (2006.01)
*H01H 85/56* (2006.01)

(52) U.S. Cl.
CPC ..... *H01H 85/38* (2013.01); *H01H 85/56* (2013.01); *H01H 2085/388* (2013.01)

(58) Field of Classification Search
CPC ..... H01H 85/055; H01H 85/08; H01H 85/10–12; H01H 85/165; H01H 85/38; H01H 85/43; H01H 85/58; H01H 2085/381; H01H 2085/383; H01H 2085/388
See application file for complete search history.

(56) References Cited

U.S. PATENT DOCUMENTS 1,443,886 A * 1/1923 Sands ..... H01H 85/143 337/234
1,447,798 A * 3/1923 McDonald ..... H01H 85/157 337/237
2,143,037 A * 1/1939 Smith, Jr. ..... H01H 85/42 337/276
3,418,614 A * 12/1968 Krueger ..... H01H 85/0458 337/229
3,601,737 A * 8/1971 Baird ..... H01H 85/055 337/159
4,032,879 A * 6/1977 Monagan ..... H01H 85/42 337/281
4,121,187 A * 10/1978 Mahieu ..... H01H 85/042 337/171

(Continued)

FOREIGN PATENT DOCUMENTS

CH 230145 A 12/1943
DE 2349270 A1 4/1975
GB 2379342 A 3/2003

OTHER PUBLICATIONS

Extended European Search Report dated Mar. 31, 2022 for European Patent Appln No. 21206456.2.

*Primary Examiner* — Jacob R Crum
(74) *Attorney, Agent, or Firm* — KDW Film PLLC

(57) ABSTRACT

A fuse including a fuse body having a main body portion formed of a dielectric material, a plurality of arc chambers formed in the main body portion, the arc chambers arranged in a matrix configuration, a conductor extending through the main body portion and intersecting the arc chambers, the conductor having bridge portions disposed within the arc chambers, the bridge portions being mechanically weaker than other portions of the conductor and configured to melt and separate upon the occurrence of an overcurrent condition in the fuse.

15 Claims, 3 Drawing Sheets

(56) References Cited

U.S. PATENT DOCUMENTS

| | | | | |
|---|---|---|---|---|
| 5,101,187 | A * | 3/1992 | Yuza | H01H 85/0417 337/260 |
| 5,903,208 | A * | 5/1999 | Sorger | H01H 85/38 337/228 |
| 6,452,474 | B1 * | 9/2002 | Oh | H01H 85/0417 337/186 |
| 2003/0218528 | A1 * | 11/2003 | Stavnes | H01H 85/38 337/186 |
| 2016/0005561 | A1 * | 1/2016 | Enriquez | H01H 85/08 337/297 |
| 2016/0217960 | A1 * | 7/2016 | Abad | H01H 85/143 |
| 2018/0053617 | A1 * | 2/2018 | Miller | H01H 85/06 |
| 2018/0061607 | A1 * | 3/2018 | Schlaak | H01H 85/157 |

* cited by examiner

*(A-A from FIG. 2)*

*(B-B from FIG. 2)*

MODULAR HIGH VOLTAGE FUSE

CROSS-REFERENCES TO RELATED APPLICATIONS

This application claims the benefit of U.S. Provisional Patent Application No. 63/113,342, filed Nov. 13, 2020, which is incorporated by reference herein in its entirety.

BACKGROUND

Field

The present disclosure relates generally to the field of circuit protection devices. More specifically, the present disclosure relates to a modular high voltage fuse that is compact, lightweight, and easily modified to suit a range of applications.

Description of Related Art

Fuses are commonly used as circuit protection devices and are typically installed between a source of electrical power and a load in an electrical circuit. A conventional fuse includes a fusible element disposed within a hollow, electrically insulating fuse body. Upon the occurrence of a fault condition, such as an overcurrent condition, the fusible element melts or otherwise separates to interrupt the flow of electrical current through the fuse. The load is thereby electrically isolated, thus preventing or at least mitigating damage to the load.

In some cases, after the fusible element of a fuse melts, an electrical arc may propagate across an air gap between the separated ends of the fusible element. If not extinguished, the arc may allow significant follow-on currents to flow through the fuse, potentially damaging the load and/or creating hazardous conditions. In order to minimize the detrimental effects of electrical arcing fuses are often filled with so-called "fuse filler" materials that surround a fusible element. A material that is commonly used as a fuse filler is sand. Sand absorbs heat when its phase changes from solid to liquid when exposed to heat generated by an electrical arc. Thus, by drawing heat away from an electrical arc, sand rapidly cools and quenches the arc.

One problem that is associated with the use of sand and other fuse filler materials is that they tend to be heavy. This can be highly undesirable, especially in modern electrical applications (e.g., electrical systems operating at greater than 100V within automobiles) in which minimizing the weight of components is a primary consideration. A further problem with sand and other fuse filler materials is that they are difficult to work with and thus increase the complexity and cost of manufacturing processes. It is with respect to these and other considerations that improvements described in the present disclosure may be useful.

SUMMARY

This Summary is provided to introduce a selection of concepts in a simplified form. This Summary is not intended to identify key features or essential features of the claimed subject matter, nor is this Summary intended as an aid in determining the scope of the claimed subject matter.

A fuse in accordance with a non-limiting embodiment of the present disclosure may include a fuse body including a main body portion formed of a dielectric material, a plurality of arc chambers formed in the main body portion, the arc chambers arranged in a matrix configuration, a conductor extending through the main body portion and intersecting the arc chambers, the conductor having bridge portions disposed within the arc chambers, the bridge portions being mechanically weaker than other portions of the conductor and configured to melt and separate upon the occurrence of an overcurrent condition in the fuse.

Another fuse in accordance with a non-limiting embodiment of the present disclosure may include a fuse body including a main body portion formed of a dielectric material, a plurality of arc chambers formed in the main body portion, the arc chambers arranged in a matrix configuration, a conductor extending through the main body portion and intersecting the arc chambers, the conductor having bridge portions disposed within the arc chambers, the bridge portions being mechanically weaker than other portions of the conductor and configured to melt and separate upon the occurrence of an overcurrent condition in the fuse, and arc barriers disposed between adjacent arc chambers and intersecting the conductor.

DETAILED DESCRIPTION

An exemplary embodiment of a modular high voltage fuse in accordance with the present disclosure will now be described more fully hereinafter with reference to the accompanying drawings. The modular high voltage fuse may, however, be embodied in many different forms and should not be construed as being limited to the embodiments set forth herein. Rather, these embodiments are provided so that this disclosure will convey certain exemplary aspects of the modular high voltage fuse to those skilled in the art.

Figure 1:
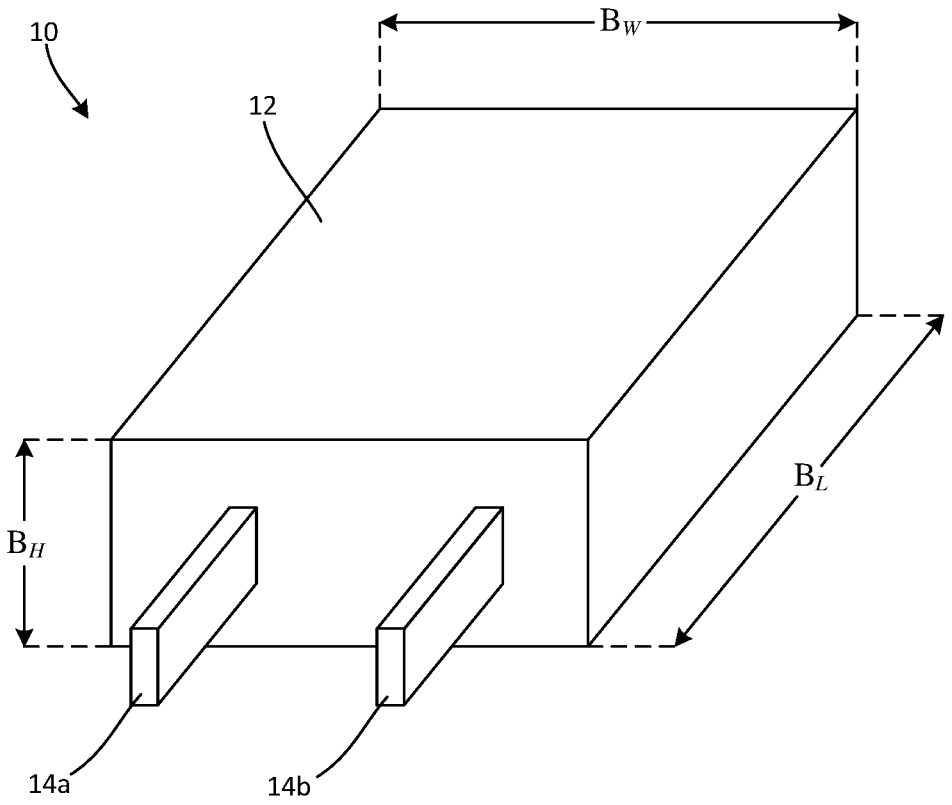
FIG. 1 is a perspective view illustrating a modular high voltage fuse in accordance with an exemplary embodiment of the present disclosure.

Referring to FIG. 1, a perspective view illustrating a modular high voltage fuse 10 (hereinafter "the fuse 10") in accordance with an exemplary embodiment of the present disclosure is shown. For the sake of convenience and clarity, terms such as "front," "rear," "top," "bottom," "up," "down," "above," "below," etc. may be used herein to describe the relative placement and orientation of various components of the fuse 10, each with respect to the geometry and orientation of the fuse 10 as it appears in FIG. 1. Said terminology will include the words specifically mentioned, derivatives thereof, and words of similar import.

Figure 2:
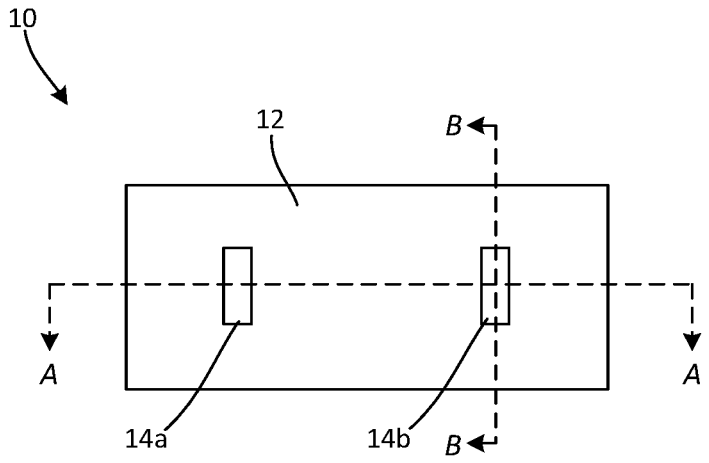
FIG. 2 is a front view illustrating the modular high voltage fuse shown in FIG. 1.

Referring to FIGS. 1 and 2, the fuse 10 may include a dielectric fuse body 12 having electrically conductive first and second terminals 14*a* , 14*b* protruding from a front surface thereof. The fuse body 12 may have generally cuboid or cylindric shape, and the first and second terminals 14*a* , 14*b* may be substantially planar prongs that extend from the fuse body 12 in a parallel, spaced apart relationship. The forgoing description is not intended to be limiting, as the fuse body 12 and the first and second terminals 14*a* , 14*b* may be implemented in a variety of different shapes and configurations without departing from the scope of the present disclosure. The terminals 14*a* , 14*b* may be the end portions of a single conductor 20 (see FIGS. 3 and 4) that extends through an interior of the fuse body 12 as further described below.

In various non-limiting, exemplary embodiments, the fuse body 12 may have a length $B_L$ in a range of 10 millimeters to 100 millimeters, a width $B_W$ in a range of 10 millimeters to 50 millimeters, and a height $B_H$ in a range of 5 millimeters to 25 millimeters. In a particular non-limiting example, the fuse body 12 may have a length $B_L$ of 25 millimeters, a width $B_W$ of 18 millimeters, and a height $B_H$ of 16 millimeters. In another non-limiting example, the fuse body 12 may have a length $B_L$ of 45 millimeters, a width $B_W$ of 18 millimeters, and a height $B_H$ of 22 millimeters. In another non-limiting example, the fuse body 25 may have a length $B_L$ of 25 millimeters, a width $B_W$ of 32 millimeters, and a height $B_H$ of 22 millimeters.

Figure 3:
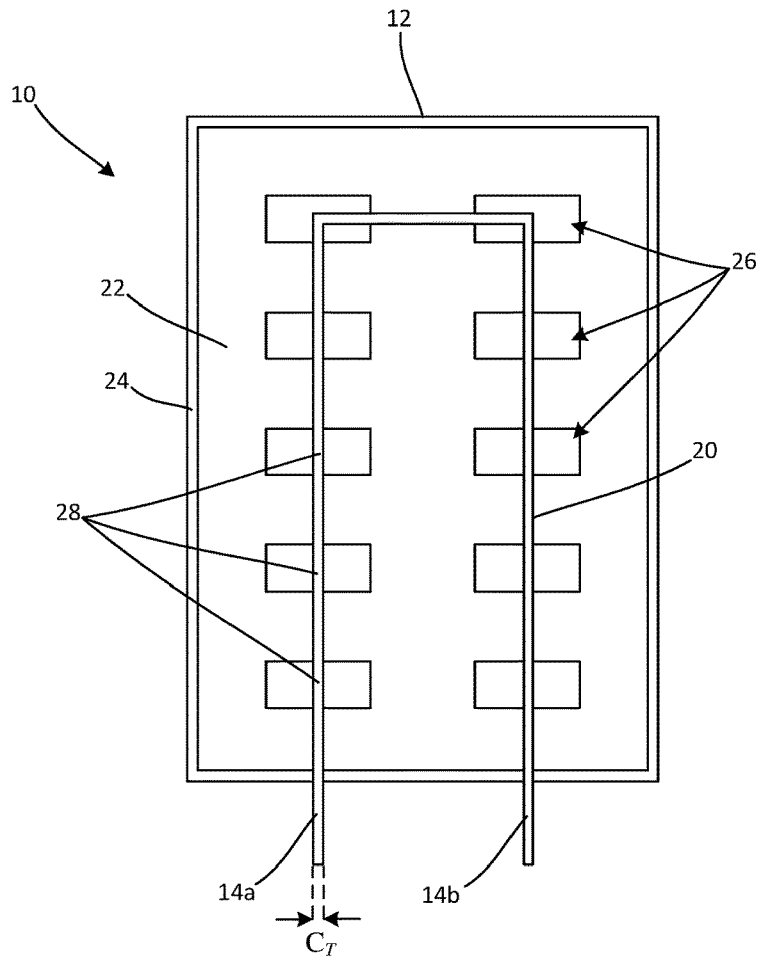
FIG. 3 is a cross-sectional view illustrating the modular high voltage fuse shown in FIG. 1 taken along plane A-A in FIG. 2.
Figure 4:
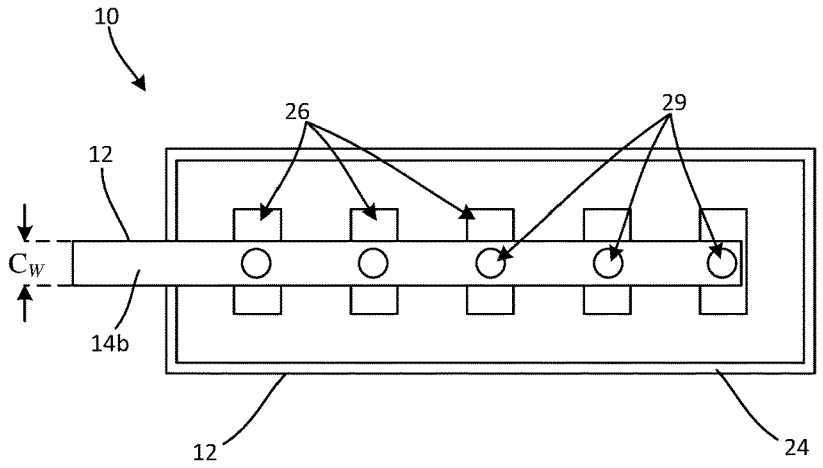
FIG. 4 is a cross-sectional view illustrating the modular high voltage fuse shown in FIG. 1 taken along plane B-B in FIG. 2.

Referring to the cross-sectional views of the fuse 10 illustrated in FIGS. 3 and 4, the fuse body 12 may include a main body portion 22 encased within a shell 24. The main body portion 22 may be formed of a dielectric material that exhibits high outgassing, low arc tracking, and arc quenching characteristics, and that is also amenable to molding. Examples of such materials include, but are not limited to, silicon, melamine, polyamides, etc. The shell 24 may be formed of plastic or other rigid materials (i.e., more rigid than the material of the main body portion 22) for providing the fuse 10 with rigidity and durability. In various embodiments, the shell 24 may be omitted if the main body portion 22 is formed of a sufficiently rigid, durable material.

The main body portion 22 of the fuse body 12 may contain a plurality of cavities, hereinafter referred to as "arc chambers" 26. The arc chambers 26 may be generally rectangular and may be arranged in a matrix configuration with a plurality of rows and columns as shown in the cross-sectional view of FIG. 3. For example, the main body portion 22 may contain a total of 10 arc chambers 26 (5 columns×2 rows) as shown in FIG. 3. The present disclosure is not limited in this regard. The total number of arc chambers 26 and the arrangement of the arc chambers 26 within the main body portion 22 may be varied to suit a voltage requirement of the fuse 10 as further described below.

Still referring to FIGS. 3 and 4, the conductor 20, having opposing ends that define the above-described terminals 14*a* , 14*b* , may extend through the main body portion 22 of the fuse body 12 and may intersect and extend through each of the arc chambers 26. In various embodiments, the main body portion 22, including the arc chambers 26, may be formed onto/around the conductor 20 using conventional molding processes (e.g., overmolding, injection molding, etc.), and may be formed in two or more portions that may be bonded (e.g., ultrasonically welded) together. The conductor 20 may be formed of an elongate, substantially planar strip of metal (e.g., copper, tin, nickel, etc.) having a thickness $C_T$ and a width $C_W$ that may be bent or otherwise shaped to conform to the configuration of the arc chambers 26. For example, the conductor 20 may be bent into a U-shape to conform to the 5×2 matrix of arc chambers 26 depicted in FIG. 3. The present disclosure is not limited in this regard.

The portions of the conductor 20 that extend through the arc chambers 26, hereinafter referred to as the "bridge portions" 28, may be mechanically weakened relative to other portions of the conductor 20 so that the bridge portions 28 will melt and separate upon the occurrence of an overcurrent condition in the fuse 10. For example, the bridge portions 28 may have holes 29 formed in them as shown in FIG. 4. The present disclosure is not limited in this regard. In various embodiments, the bridge portions 28 may be notched, slotted, or otherwise narrowed or weakened to facilitate separation if an amount of current flowing through the fuse 10 exceeds a predefined threshold.

Figure 5:
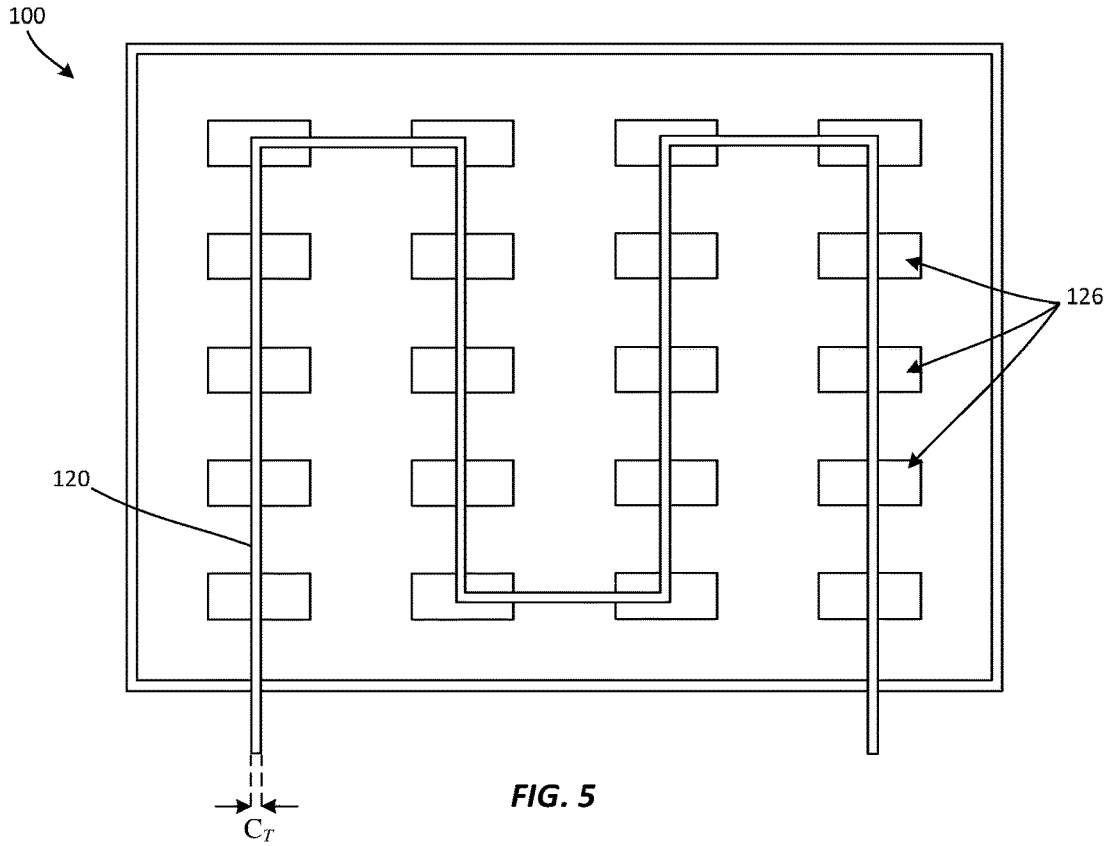
FIG. 5 is a cross-sectional view illustrating another modular high voltage fuse in accordance with an exemplary embodiment of the present disclosure.

Generally, the voltage rating of the fuse 10 will be dictated by the total number of arc chambers 26 (and therefore the total number of bridge portions 28) in the main body portion 22, with each arc chamber 26 contributing a certain amount of voltage to the voltage rating, depending on the current rating of the fuse 10. The present disclosure is not limited in this regard. The current rating of the fuse 10 will be dictated by the cross-sectional size of the conductor 20 (i.e., $C_T \times C_W$). In a non-limiting example, the fuse 10 may include a total of 10 arc chambers 26 (as shown in FIG. 3) and the conductor 20 may have a thickness $C_T$ of 1 millimeter and a width $C_W$ of 8 millimeters, providing the fuse 10 with a voltage rating of approximately 500 VAC and a current rating of approximately 200 Å. Referring to FIG. 5, a cross-sectional view of a fuse 100 representing a non-limiting, alternative embodiment of the above-described fuse 10 is shown. The fuse 100 may be substantially similar to the fuse 10 but may include a total of 20 arc chambers 126 (arranged in a 5×4 matrix) and the conductor 120, which is bent/arranged in a serpentine configuration to intersect all of the arc chambers 126, may have a thickness $C_T$ of 1 millimeter and a width $C_W$ of 16 millimeters (not within view), providing the fuse 100 with a voltage rating of approximately 1000 VAC and a current rating of approximately 400 Å.

It will be appreciated that the specific configurations of the fuses 10 and 100 described above and shown in FIGS. 1-5 are provided by way of example only, and that the number and arrangement of the arc chambers and/or the widths and thicknesses of the conductors may be increased or decreased to suit a particular application (e.g., a desired voltage rating, current rating, and fuse size) without departing from the scope of the present disclosure. Advantageously, the total number of arc chambers and the dimensions of the conductor can be varied without substantially affecting the height $B_H$ of the fuse body 12 (see FIG. 1).

Figure 6:
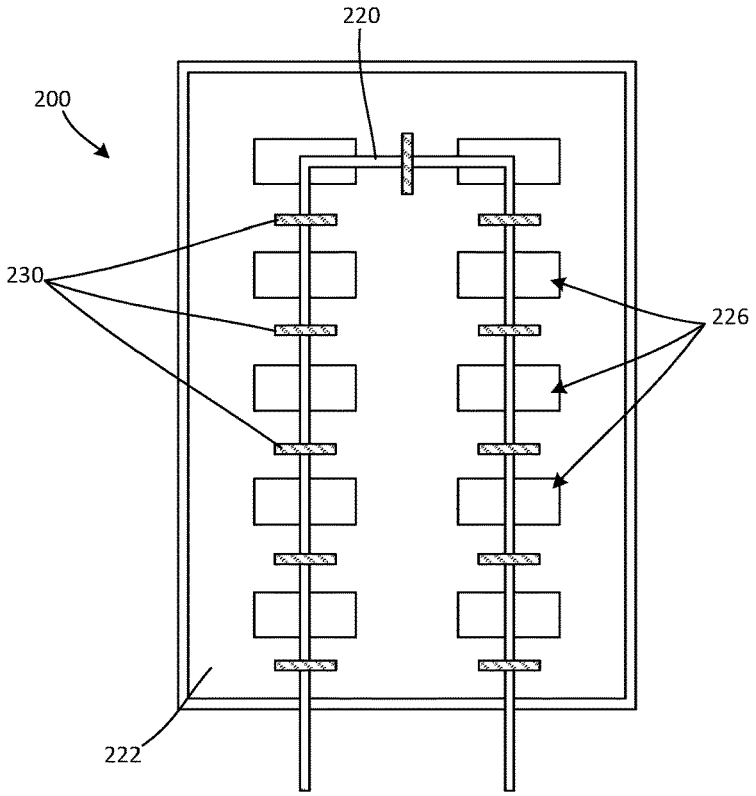
FIG. 6 is a cross-sectional view illustrating another modular high voltage fuse in accordance with an exemplary embodiment of the present disclosure.

Referring to FIG. 6, a cross-sectional view of a fuse 200 representing another non-limiting, alternative embodiment of the above-described fuse 10 is shown. The fuse 200 may be substantially similar to the fuse 10 but may include a plurality of arc barriers 230 located on opposing sides of each of the arc chambers 226 in the path of the conductor 220. The arc barriers 230 may be formed of metal plates having slots or apertures formed therein for allowing the conductor 220 to pass through the arc barriers 130. In various embodiments, the arc barriers 230 may be formed of steel, brass, copper, etc. and may be overmolded, injection molded, etc. with the material of the main body portion 222 in the same manner and at the same time as the conductor 220 during manufacture (as described above with respect to the conductor 20). The present disclosure is not limited in this regard. Upon the occurrence of an overcurrent condition in the fuse 200, electrical arcs may form in one or more of the arc chambers 226 and may rapidly burn through the material of the main body portion 222 (e.g., melamine)

between the arc chambers 226. The arc barriers 230, which may have a greater heat capacity than the material of the main body portion 222, may absorb heat from the arc(s) and may thus mitigate this burn-through.

It will be appreciated by those of ordinary skill in the art that the above-described embodiments provide a modular high voltage fuse that is compact and lightweight and that can be manufactured and modified more easily and at a lower cost relative to conventional fuses that employ fuse fillers such as sand and silica. The embodiments of the present disclosure may thus be particularly well suited for automotive applications and the like.

As used herein, an element or step recited in the singular and proceeded with the word "a" or "an" should be understood as not excluding plural elements or steps, unless such exclusion is explicitly recited. Furthermore, references to "one embodiment" of the present disclosure are not intended to be interpreted as excluding the existence of additional embodiments that also incorporate the recited features.

While the present disclosure makes reference to certain embodiments, numerous modifications, alterations and changes to the described embodiments are possible without departing from the sphere and scope of the present disclosure, as defined in the appended claim(s). Accordingly, it is intended that the present disclosure not be limited to the described embodiments, but that it has the full scope defined by the language of the following claims, and equivalents thereof.

The invention claimed is:

1. A fuse comprising:

a fuse body including a main body portion formed of a unitary block of dielectric material;

a plurality of arc chambers molded into the main body portion, the arc chambers arranged in a matrix configuration;

arc barriers disposed within solid portions of the unitary block of dielectric material between adjacent arc chambers, wherein the arc barriers are formed of metal plates; and a conductor extending through the solid portions of the unitary block of dielectric material and intersecting the arc chambers, the conductor having bridge portions disposed within the arc chambers and surrounded by air within the arc chambers, the bridge portions being mechanically weaker than other portions of the conductor and configured to melt and separate upon occurrence of an overcurrent condition in the fuse, wherein the conductor also extends through the arc barriers.

2. The fuse of claim 1, wherein the conductor defines a serpentine shape having at least two bends formed therein.

3. The fuse of claim 1, wherein the main body portion is encased within a rigid shell.

4. The fuse of claim 1, wherein the conductor has opposing ends defining first and second terminals extending from the fuse body.

5. The fuse of claim 1, wherein the dielectric material of the main body portion is selected from a group consisting of melamine, silicon, and polyamides.

6. The fuse of claim 1, wherein the arc chambers are hollow cavities formed within a material of the main body portion.

7. The fuse of claim 1, wherein the arc chambers define a two-dimensional matrix.

8. The fuse of claim 1, wherein the fuse body has a length in a range of 10 millimeters to 100 millimeters, a width in a range of 10 millimeters to 50 millimeters, and a height in a range of 5 millimeters to 25 millimeters.

9. The fuse of claim 1, wherein the bridge portions have at least one of holes, notches, and slots formed therein.

10. The fuse of claim 1, wherein the arc chambers are rectangular.

11. A fuse comprising:

a fuse body including a main body portion formed of a unitary block of dielectric material;

a plurality of arc chambers molded into the main body portion, the arc chambers arranged in a matrix configuration;

a conductor extending through solid portions of the unitary block of dielectric material and intersecting the arc chambers, the conductor having bridge portions disposed within the arc chambers and surrounded by air within the arc chambers, the bridge portions being mechanically weaker than other portions of the conductor and configured to melt and separate upon occurrence of an overcurrent condition in the fuse; and arc barriers disposed within the solid portions of the unitary block of dielectric material between adjacent arc chambers and intersecting the conductor, wherein the arc barriers are formed of metal plates.

12. The fuse of claim 11, wherein the conductor defines a serpentine shape having at least two bends formed therein.

13. The fuse of claim 11, wherein the conductor has opposing ends defining first and second terminals extending from the fuse body.

14. The fuse of claim 11, wherein the main body portion is formed from a dielectric material selected from a group consisting of melamine, silicon, and polyamides.

15. The fuse of claim 11, wherein the bridge portions have at least one of holes, notches, and slots formed therein.

* * * * *